United States Patent [19]

Seragnoli

[11] 4,328,886

[45] May 11, 1982

[54] DEVICE FOR FEEDING CIGARETTES IN BULK TO THE HOPPER OF A PACKAGING MACHINE

[75] Inventor: Enzo Seragnoli, Bologna, Italy

[73] Assignee: G. D. Societa per Azioni, Bologna, Italy

[21] Appl. No.: 123,659

[22] Filed: Feb. 22, 1980

[30] Foreign Application Priority Data

Mar. 5, 1979 [IT] Italy ..... 3339 A/79

[51] Int. Cl.[3] ..... B65G 1/00

[52] U.S. Cl. ..... 198/347; 198/524

[58] Field of Search ..... 198/347, 502, 573, 575, 198/577, 524, 537, 560, 569; 53/493, 503; 131/21 R, 21 A, 21 B, 25, 282, 909

[56] References Cited

U.S. PATENT DOCUMENTS 3,952,854 4/1976 Selonke et al. ..... 198/347

4,142,622 3/1979 Seragnoli ..... 198/347

FOREIGN PATENT DOCUMENTS 2652363 5/1978 Fed. Rep. of Germany ..... 198/347

*Primary Examiner*—Joseph E. Valenza

*Attorney, Agent, or Firm*—Merriam, Marshall & Bicknell

[57] ABSTRACT

A device for feeding cigarettes in bulk to the inlet hopper of a packaging machine, in which a feed channel for cigarettes is connected to an upper aperture of a compartment, a lower aperture of which is connected to the inlet hopper, and a lateral aperture of which is connected to at least one variable capacity store, said compartment including two channels extending between said upper aperture and said lower aperture, and of which one is a substantially straight vertical fall channel, and the other is a secondary curved channel communicating with said store and enclosing store-capacity control means.

4 Claims, 3 Drawing Figures

DEVICE FOR FEEDING CIGARETTES IN BULK TO THE HOPPER OF A PACKAGING MACHINE

BACKGROUND OF THE INVENTION

This invention relates to a device for feeding cigarettes in bulk to the hopper of a packaging machine. In feed systems for cigarette packaging machines, it is known to utilise feed devices comprising a mobile wall feed channel arranged to continuously receive cigarettes in bulk from at least one cigarette production machine, a compartment arranged for connection to the inlet hopper of said packaging machine and to receive cigarettes from said feed channel, and at least one mobile wall store communicating with said compartment and controlled by means for measuring the quantity of cigarettes present therein.

In these known feed devices, said compartment is normally constituted by a substantially vertical fall channel, of which the upper end is connected to the outlet end of said feed channel and the lower end is connected to said hopper.

Normally, a substantially vertical side wall of the fall channel comprises apertures aligned one below the other and each constituting the inlet-outlet mouth of a respective said mobile wall store.

This latter is normally controlled by a respective pressure sensor disposed in a side wall of the fall channel in a position facing said inlet-outlet mouth. When in operation, the cigarettes are fed to the packaging machine hopper by moving transversely to themselves along the fall channel at a relatively high flow speed, and apply to the walls of the fall channel a pressure normally lying between a predetermined minimum value and a predetermined maximum value.

If for any reason the rate of absorption of the cigarettes by the packaging machine falls, the pressure inside the fall channel increases until it reaches and then exceeds said maximum value, with the result that said pressure sensors cause said stores to operate in the sense that their mobile walls move in such a manner as to receive the excess cigarettes which are not absorbed by the packaging machine.

In contrast, if the packaging machine operates normally and the cigarette production rate of the production machine decreases, the pressure inside the fall channel decreases to below said minimum value, so that said pressure sensors cause said stores to operate in the sense that their mobile walls move in order to feed into the fall channel a quantity of cigarettes sufficient to compensate for the reduction in the production rate of the production machine.

Generally, known feed devices as heretofore described operate correctly only when the flow speed of the cigarettes along the fall channel is relatively low. Instead, when a packaging machine of high production rate is used, for example a packaging machine capable of producing up to seven packets per second, the relatively high flow speed of the cigarettes along the fall channel hinders correct operation of the pressure sensors. This is because these latter are generally disposed in front of the mouths of the respective stores, i.e. at points in the fall channel at which the cigarette flow is particularly disturbed due to the fact that in each of these positions one of the walls of the fall channel is defined by the cigarettes at rest over the store mouth.

Because of contact with the cigarettes moving rapidly along the fall channel, these stationary cigarettes tend not only to rotate about their own axis in the manner of rollers of a roller guide, thus expelling their tobacco, but also to emerge from the mouth of the relative store to add to the cigarettes in movement, so creating small pressure waves. If the pressure sensors are sufficiently sensitive (as is necessary for feed systems for fast packaging machines) these pressure waves can cause sudden undesirable operation of the stores, which can be particularly damaging.

SUMMARY OF THE INVENTION

The object of the present invention is to provide a feed device in which the aforesaid drawbacks are absent. Said object is attained according to the present invention by a device for feeding cigarettes in bulk to the inlet hopper of a packaging machine comprising a feed channel arranged to continuously receive cigarettes from at least one production machine, a compartment arranged for connection to the inlet hopper by way of a lower aperture and to receive cigarettes from said feed channel through an upper aperture, at least one variable capacity store communicating with said compartment, and means for controlling the capacity of said store in accordance with the quantity of cigarettes present inside said compartment, characterised in that wall means are disposed inside said compartment to define in the interior thereof two channels extending between said upper aperture and said lower aperture, and of which one is a substantially straight vertical fall channel, and the other is a secondary curved channel; an inlet-outlet mouth of said store opening into said secondary channel, and said control means being disposed in said secondary channel.

In the feed device according to the invention as heretofore defined, the inlet hopper is fed simultaneously by two cigarette streams, of which the first, which is relatively fast, moves along said fall channel, and the second, which is relatively slow, moves along said secondary curved channel. In this manner, whatever the speed at which the cigarettes flow along the main channel, the flow speed along the secondary channel is always such as to allow correct operation of relatively high sensitivity sensors.

It should be noted that the feed device according to the invention as heretofore defined also partly solves the difficulty due to the emptying of the cigarettes. This is because as a result of the low speed with which the cigarettes move along the secondary channel, the friction which arises between the moving cigarettes and the stationary cigarettes at the mouth of the store is insufficient to cause the cigarettes to roll. Said friction force is substantially insignificant at the two connection sections between the fall channel and the secondary channel, as the cigarettes emerging from the secondary channel fall directly into the hopper, and the cigarettes which penetrate into the secondary channel are immediately removed from contact with the cigarettes moving along the fall channel.

BRIEF DESCRIPTION OF THE DRAWINGS

Further characteristics and advantages of the present invention will be apparent from the description given hereinafter of some non-limiting embodiments thereof, with reference to the accompanying drawings in which.

DETAILED DESCRIPTION OF THE INVENTION

Figure 1:
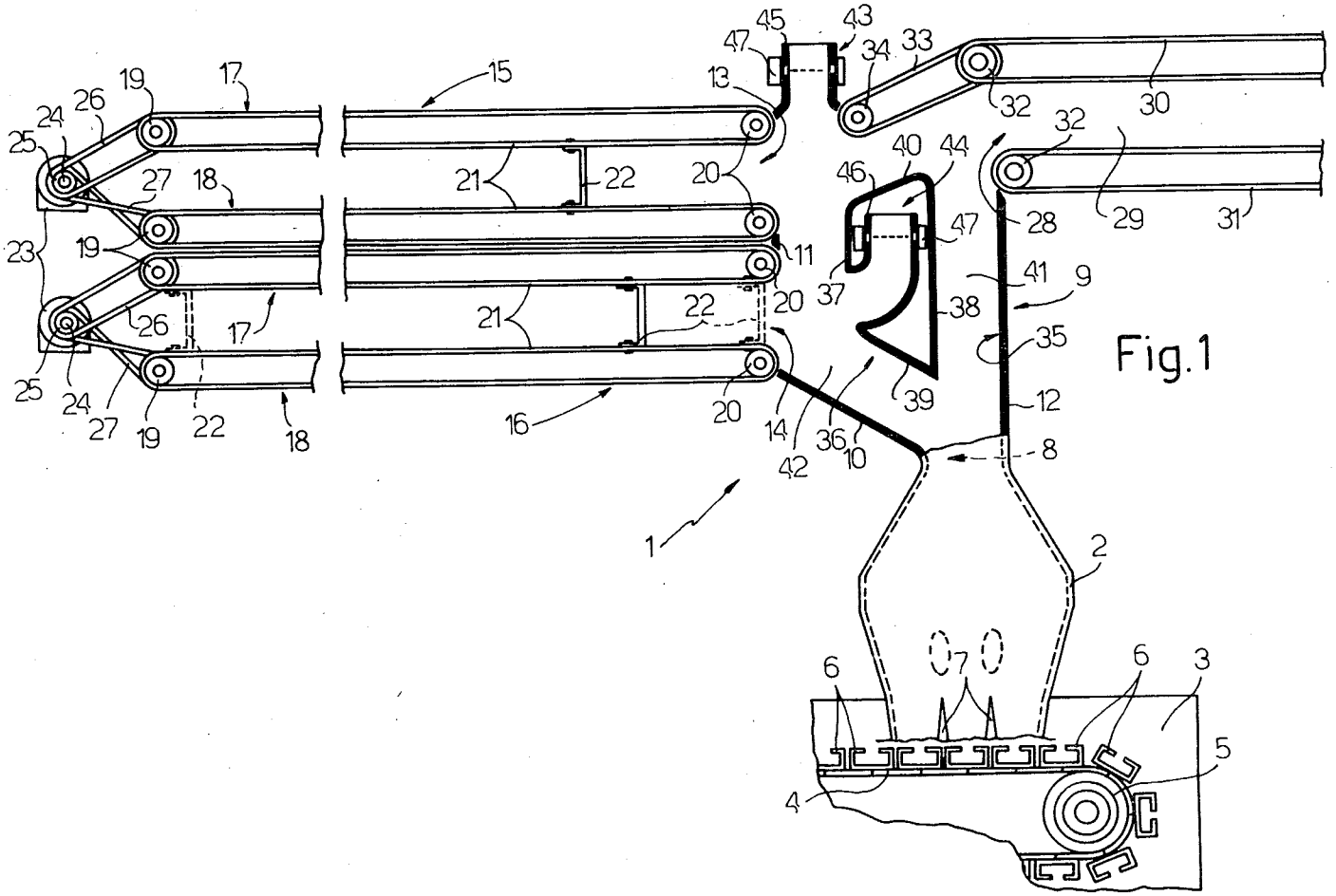
FIG. 1 is a diagrammatic section through a first embodiment of a feed device according to the present invention.
Figures 2, 3:
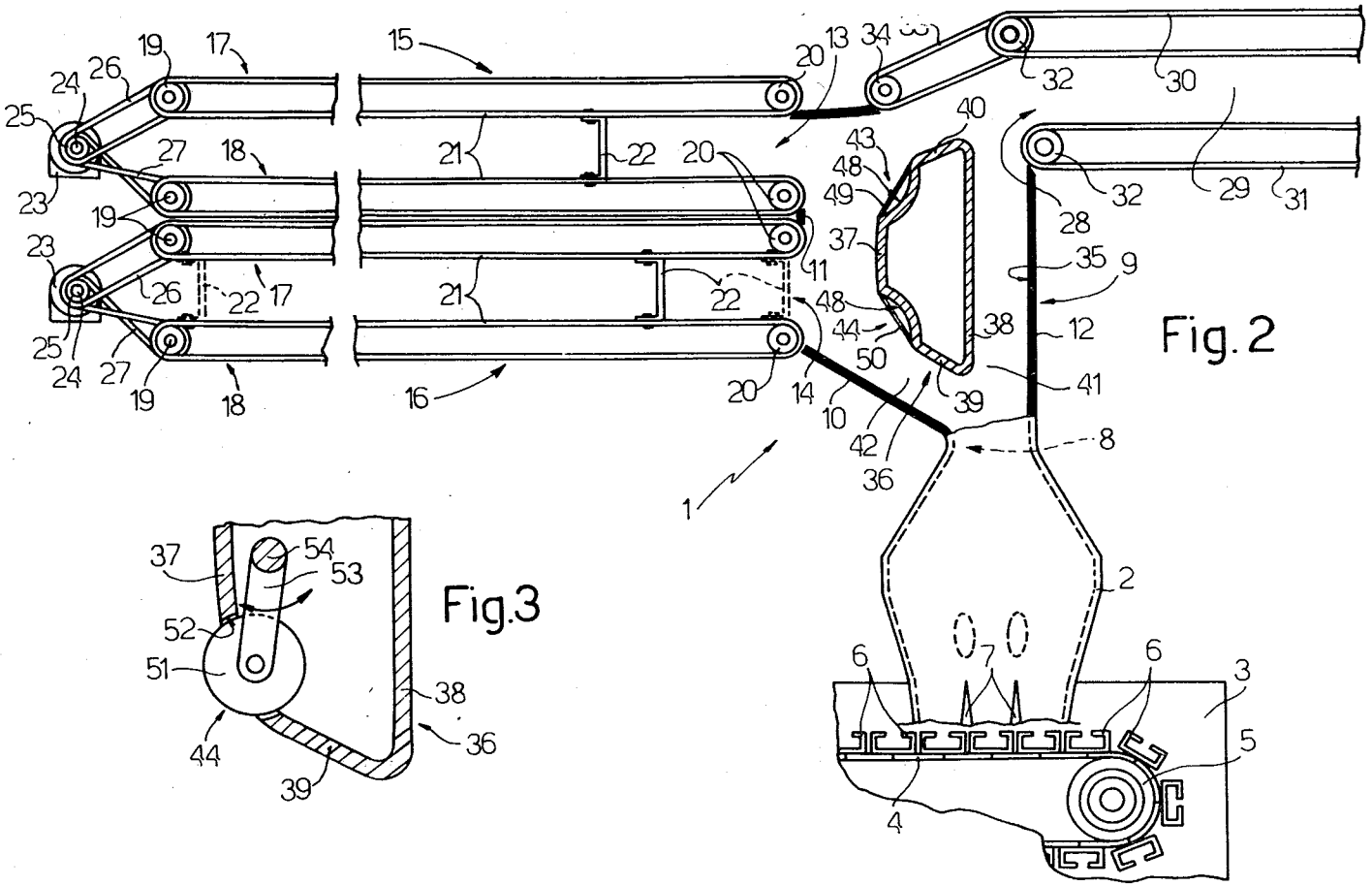
FIG. 2 is a diagrammatic section through a modification of the device illustrated in FIG. 1.
FIG. 3 is a diagrammatic section through a modification of a detail of FIGS. 1 and 2.

FIGS. 1 and 2 show a feed device indicated overall by 1 and arranged to feed bulk cigarettes (not shown) produced by a cigarette production machine (not shown) to the hopper 2 of a packaging machine 3. In this latter there is provided an intermittent conveyor 4 which rotates around deviation rollers 5 (of which only one is shown), and is provided with a plurality of boxes 6.

These latter are arranged to contain groups of a predetermined number of cigarettes arriving from the hopper 2, which is divided at its lower or outlet end into a number of channels by means of baffles 7.

The hopper 2 comprises an upper inlet aperture 8 communicating with the lower end of a container 9 rigidly connected to the hopper 2, and comprising a downwardly inclined lower wall 10 connected at its bottom to a side edge of the aperture 8, a first side wall 11 extending upwards from the upper end of the wall 10, and a second substantially vertical side wall 12 extending upwards from the side edge of the aperture 8 opposite that connected to the lower end of the wall 10. The container 9 is further defined by two vertical side walls, not shown, disposed perpendicular to the walls 10, 11 and 12 at a distance from each other which is at least equal to the length of the cigarettes fed to the hopper 2.

Two apertures 13 and 14 are provided in the side wall 11 to define the inlet-outlet mouths of two variable capacity stores 15 and 16 disposed in a substantially horizontal position, the first above the second. Each store 15, 16, the axis of which can be disposed other than horizontal according to requirements, is of the mobile wall type, and comprises an upper belt conveyor 17 and a lower belt conveyor 18 passing around rollers 19 and 20, and in which two facing parallel arms 21 carry a mobile wall 22 rigidly connected thereto.

Each pair of conveyors 17 and 18 is driven by a respective reversible motor 23, the exit shaft 24 of which has keyed thereon a double pulley 25 about which two belts 26 and 27 pass in order to rotate the rollers 19 in opposite directions.

At the upper end of the wall 12, the container 9 comprises a side inlet opening 28 through which the container 9 communicates with a feed channel 29 defined by two belt conveyors 30 and 31, each of which passes around a first roller 32 disposed at the aperture 28, and a second roller (not shown) disposed in proximity to said production machine, not shown.

The upper wall of the container 9 is partly defined by a belt conveyor 33 passing around the upper roller 32 and a second roller 34 and defining, together with the walls 10, 11 and 12 and the said two vertical side walls, not shown, a compartment 35 which when viewed in elevation is of substantially trapezoidal shape with its major base disposed along the wall 12.

Inside the compartment 35 there is disposed a member 36 which when viewed in elevation is of substantially trapezoidal shape, and comprises a first side wall 37 substantially parallel to the wall 11, a second side wall 38 substantially parallel to the wall 12, a lower wall 39 substantially parallel to the wall 10 and an upper wall 40 substantially parallel to the conveyor 33.

The member 36 divides the compartment 35 into two channels 41 and 42, of which the first is a substantially vertical fall channel extending between the walls 12 and 38 to directly connect the upper aperture 28 to the aperture 8 and having a width less than the width of this latter, and the second is an auxiliary or by-pass channel of substantially U shape, which extends between the apertures 28 and 8 along the walls 40, 37 and 39 of the member 36, and joins the channel 41 at the aperture 8. The drive motors 23 for the conveyors 17 and 18 of the stores 15 and 16 are controlled by respective sensors 43 and 44 disposed in the channel 42 for determining the quantity of cigarettes present inside the compartment 35.

In the embodiment shown in FIG. 1, the sensors 43 and 44 comprise respective syphons 45 and 46, the first extending upwards from the upper wall of the container 9 between the roller 34 of the conveyor 33 and the roller 20 of the conveyor 17 of the store 15, and the second extending upwards from the wall 37 of the member 36 towards the interior of this latter.

Each syphon 45, 46 is provided with sensor means 47 for determining the level of the cigarettes in its interior, and which operate the respective motors 23 in one direction when the level of the cigarettes exceeds a maximum predetermined value, and in the other direction when the level of the cigarettes falls below a predetermined minimum value.

In the embodiment shown in FIG. 2, the sensors 43 and 44 comprise two cavities 47 and 48 provided in the outer surface of the member 36 in positions substantially facing the apertures 13 and 14 and closed by respective resilient membranes 49 and 50 provided with sensor means (not shown), which operate the respective motors 23 in one direction when the pressure imparted by the cigarettes exceeds a maximum predetermined value, and in the other direction when the pressure imparted by the cigarettes falls below a predetermined minimum value.

In the modification shown in FIG. 3, the membranes 49 and 50 of FIG. 2 are replaced by rollers 51 (of which only one is shown), each of which extends partly into the channel 42 through a respective slot 52 provided in the member 36, and is pivoted inside this latter to the end of a crank 53 pivoted on a pin 54.

In each of the embodiments shown in FIGS. 1 to 3, one of the sensors 43 and 44 can obviously take the form shown in one or other of the other two figures.

When in operation, the cigarettes fed through the channel 29 fall into the channel 41, along which they flow at a relatively high speed to feed the hopper 2.

A small proportion of the cigarettes from the channel 29 is deviated by the member 36 towards the inside of the channel 42, along which the cigarettes move at a relatively low speed until they reach the inlet aperture 8 of the hopper 2.

If a partial or total reduction in production rate occurs in one of the machines disposed at the opposite ends of the feed device 1, a pressure change occurs inside the compartment 35 and consequently in the channel 42 due to an increase or, respectively, a decrease in the number of cigarettes present inside the compartment 35.

This pressure change is sensed by the sensor devices 43 and 44, which operate the motors 23 in order to return the quantity of cigarettes present in the compartment 35 to a predetermined amount.

Within the principle of the invention, numerous modifications can be made to the described feed device 1 without leaving the scope of the inventive idea.

What I claim is:

1. A device for feeding cigarettes in bulk to the inlet hopper of a packaging machine, comprising a feed channel arranged to continuously receive cigarettes from at least one production machine, a compartment arranged for connection to the inlet hopper by way of a lower aperture and to receive cigarettes from said feed channel through an upper aperture, at least one variable capacity store communicating with said compartment, and means for controlling the capacity of said store in accordance with the quantity of cigarettes present inside said compartment, wall means are disposed inside said compartment to define in the interior thereof two channels extending between said upper aperture and said lower aperture, and of which one is of substantially straight vertical fall channel through which cigarettes can move at relatively high speed, and the other is a secondary curved channel through which cigarettes can move at relatively slow speed; an inlet-outlet mouth of said store opening into said secondary channel, and said control means being disposed in said secondary channel.

2. A device as claimed in claim 1, wherein said fall channel has a cross-section less than that of said lower aperture of said compartment, said fall channel and secondary channel joining together upstream of said lower aperture.

3. A device as claimed in claim 1, wherein said wall means comprise a member inserted into said compartment in a central position thereof.

4. A device as claimed in claim 3, wherein both said compartment and said member have an elevation of substantially trapezoidal shape.

* * * * *